US008696094B2

(12) United States Patent
Marcus et al.

(10) Patent No.: US 8,696,094 B2
(45) Date of Patent: Apr. 15, 2014

(54) PRINTING WITH MERGED DROPS USING ELECTROSTATIC DEFLECTION

(75) Inventors: Michael A. Marcus, Honeoye Falls, NY (US); James A. Katerberg, Kettering, OH (US); Hrishikesh V. Panchawagh, San Jose, CA (US)

(73) Assignee: Eastman Kodak Company, Rochester, NJ (US)

( * ) Notice: Subject to any disclaimer, the term of this patent is extended or adjusted under 35 U.S.C. 154(b) by 11 days.

(21) Appl. No.: 13/544,116

(22) Filed: Jul. 9, 2012

(65) Prior Publication Data

US 2014/0009523 A1 Jan. 9, 2014

(51) Int. Cl.
*B41J 2/07* (2006.01)
*B41J 2/115* (2006.01)
*B41J 2/185* (2006.01)

(52) U.S. Cl.
CPC .. *B41J 2/115* (2013.01); *B41J 2/185* (2013.01)
USPC ..... 347/74; 347/76; 347/90

(58) Field of Classification Search
CPC ..... B41J 2202/06; B41J 2/115
USPC ..... 347/74, 76
See application file for complete search history.

(56) References Cited

U.S. PATENT DOCUMENTS 3,373,437 A 3/1968 Sweet et al.
3,596,275 A 7/1971 Sweet
3,656,171 A 4/1972 Robertson
3,827,057 A 7/1974 Bischoff et al.
3,846,800 A * 11/1974 Chen ..... 347/76
3,946,399 A 3/1976 Zaretsky
4,054,882 A 10/1977 Ruscitto
4,068,241 A 1/1978 Yamada
4,217,595 A * 8/1980 Horike et al. ..... 347/80
4,350,986 A * 9/1982 Yamada ..... 347/75
4,613,871 A 9/1986 Katerberg
6,059,393 A * 5/2000 Takahashi ..... 347/11
6,079,821 A 6/2000 Chwalek et al.
6,235,212 B1 5/2001 Silverbrook
6,273,559 B1 8/2001 Vago et al.
6,312,110 B1 11/2001 Darty (Continued)

OTHER PUBLICATIONS

Katerberg, J. A., "Drop Charging and Deflection Using a Planar Charge Plate", 4th International Congress on Advances in Non-Impact Printing Technologies The Society for Imaging Science and Technology, Mar. 20, 1988.

(Continued)

*Primary Examiner* — Shelby Fidler
(74) *Attorney, Agent, or Firm* — William R. Zimmerli

(57) ABSTRACT

An apparatus and method of ejecting liquid drops includes modulating a liquid jet to cause it to break off into drop clusters, including first and second drops traveling along a path, separated on average by a drop cluster period. An input image data independent charging waveform of a charging device includes a period that is equal to the cluster period and first and second voltage states having opposing polarities. The charging device produces first and second charge states on the first and second drops, respectively, of each cluster. The first and second drops are deflected away from the path toward first and second catchers, respectively. Relative velocity of drops of a selected drop cluster is modulated in response to input print data causing the drops to form a merged drop traveling along the path having a third charge state that prevents it from being deflected to either catcher.

19 Claims, 9 Drawing Sheets

(56) References Cited

U.S. PATENT DOCUMENTS

| | | | | |
|---|---|---|---|---|
| 6,450,619 | B1 | 9/2002 | Anagnostopoulos et al. | |
| 6,509,917 | B1 | 1/2003 | Chwalek et al. | |
| 6,554,410 | B2 | 4/2003 | Jeanmaire et al. | |
| 6,588,888 | B2 | 7/2003 | Jeanmaire et al. | |
| 7,192,121 | B2 | 3/2007 | Barbet et al. | |
| 7,364,276 | B2 | 4/2008 | Piatt et al. | |
| 7,712,879 | B2 | 5/2010 | Barbet | |
| 7,837,307 | B2 * | 11/2010 | Schmitt | 347/77 |
| 7,938,516 | B2 | 5/2011 | Piatt et al. | |
| 2006/0071978 | A1 * | 4/2006 | Steiner et al. | 347/55 |
| 2006/0139408 | A1 | 6/2006 | Barbet et al. | |
| 2009/0153627 | A1 | 6/2009 | Barbet | |
| 2009/0225112 | A1 | 9/2009 | Barbet | |
| 2009/0231398 | A1 | 9/2009 | Barbet | |
| 2010/0033542 | A1 | 2/2010 | Piatt et al. | |

OTHER PUBLICATIONS

Lord Rayleigh, "On the Instability of Jets," *Proc. London Math*. Soc. X (1878).

Panchawagh, H. et al., U.S. Appl. No. 13/115,434, "Ejecting Liquid Using Drop Charge and Mass", filed May 25, 2011.

Panchawagh, H. et al., U.S. Appl. No. 13/115,465, "Liquid Ejection System Including Drop Velocity Modulation", filed May 25, 2011.

Panchawagh, H. et al., U.S. Appl. No. 13/115,482, "Liquid Ejection Method Using Drop Velocity Modulation", filed May 25, 2011.

Panchawagh, H. et al., U.S. Appl. No. 13/115.421, "Liquid Ejection Using Drop Charge and Mass", filed May 25, 2011.

* cited by examiner

PRINTING WITH MERGED DROPS USING ELECTROSTATIC DEFLECTION

CROSS REFERENCE TO RELATED APPLICATIONS

Reference is made to commonly-assigned, U.S. patent application Ser. No. 13/530,161, entitled "CONTROLLING DROP CHARGE USING DROP MERGING DURING PRINTING", filed Jun. 22, 2012.

FIELD OF THE INVENTION

This invention relates generally to the field of digitally controlled printing systems, and in particular to continuous printing systems in which a liquid stream breaks into drops some of which are electrostatically deflected.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfer and fixing. Ink jet printing mechanisms can be categorized by technology as either drop on demand ink jet (DOD) or continuous ink jet (CIJ).

The first technology, "drop-on-demand" ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed in a manner such that the liquid jet breaks up into drops of ink in a predictable manner. Printing occurs through the selective deflecting and catching of undesired ink drops. Various approaches for selectively deflecting drops have been developed including electrostatic deflection, air deflection, and thermal deflection mechanisms.

One well-known problem with any type inkjet printer, whether drop-on-demand or continuous ink jet, relates to the accuracy of dot positioning. As is well-known in the art of inkjet printing, one or more drops are generally desired to be placed within pixel areas (pixels) on the receiver, the pixel areas corresponding, for example, to pixels of information comprising digital images. Generally, these pixel areas comprise either a real or a hypothetical array of squares or rectangles on the receiver, and printer drops are intended to be placed in desired locations within each pixel, for example in the center of each pixel area, for simple printing schemes, or, alternatively, in multiple precise locations within each pixel areas to achieve half-toning. If the placement of the drop is incorrect and/or their placement cannot be controlled to achieve the desired placement within each pixel area, image artifacts may occur, particularly if similar types of deviations from desired locations are repeated on adjacent pixel areas.

In a first electrostatic deflection based CIJ approach, the liquid jet stream is perturbed in some fashion causing it to break up into uniformly sized drops at a nominally constant distance, the break off length, from the nozzle. A charging electrode structure is positioned at the nominally constant break off point so as to induce a data-dependent amount of electrical charge on the drop at the moment of break off. The charged drops are then directed through a fixed electrostatic field region causing each droplet to deflect proportionately to its charge. The charge levels established at the break off point thereby cause drops to travel to a specific location on a recording medium or to a gutter for collection and recirculation. This approach is disclosed by R. Sweet in U.S. Pat. No. 3,596,275, issued Jul. 27, 1971, Sweet '275 hereinafter. The CIJ apparatus disclosed by Sweet '275 consisted of a single jet, i.e. a single drop generation liquid chamber and a single nozzle structure. A disclosure of a multi-jet CIJ printhead version utilizing this approach has also been made by Sweet et al. in U.S. Pat. No. 3,373,437 issued Mar. 12, 1968, Sweet '437 hereinafter. Sweet '437 discloses a CIJ printhead having a common drop generator chamber that communicates with a row (an array) of drop emitting nozzles each with its own charging electrode. This approach requires that each nozzle have its own charging electrode, with each of the individual electrodes being supplied with an electric waveform that depends on the image data to be printed. This requirement for individually addressable charge electrodes places limits on the fundamental nozzle spacing and therefore on the resolution of the printing system.

One known problem with these conventional CIJ printers is variation in the charge on the print drops caused by image data-dependent electrostatic fields from neighboring charged drops in the vicinity of jet break off and electrostatic fields from adjacent electrodes associated with neighboring jets. These input image data dependent variations are referred as electrostatic cross talk. Katerberg disclosed a method to reduce the cross-talk interactions from neighboring charged drops by providing guard gutter drops between adjacent print drops from the same jet in U.S. Pat. No. 4,613,871. However, electrostatic cross talk from neighboring electrodes limits the minimum spacing between adjacent electrodes and therefore resolution of the printed image. Thus, the requirement for individually addressable charge electrodes in traditional electrostatic CIJ printers places limits on the fundamental nozzle spacing and therefore on the resolution of the printing system. A number of alternative methods have been disclosed to overcome the limitation on nozzle spacing by use of an array of individually addressable nozzles in a nozzle array and one or more common charge electrodes at constant potentials. This is accomplished by controlling the jet break off length as described by Vago et al. in U.S. Pat. No. 6,273,559 and by B. Barbet and P. Henon in U.S. Pat. No. 7,192,121. T. Yamada disclosed a method of printing using a charge electrode at constant potential based on drop volume in U.S. Pat. No. 4,068,241. B. Barbet in U.S. Pat. No. 7,712,879 disclosed an electrostatic charging and deflection mechanism based on break off length and drop size using common charge electrodes at constant potentials. M. Piatt and R. Fagerquist in U.S. Pat. No. 7,938,516 disclosed an approach to produce selective charging and deflection of droplets formed at different phases (time) of a common charge electrode.

Other known problems with electrostatic deflection based CIJ printing systems include electrostatic interactions between adjacent drops which cause alterations of their in-flight paths and result in degraded print quality and drop registration. P. Ruscitto in U.S. Pat. No. 4,054,882 described a method of non sequential printing of ink drops issuing sequentially from a nozzle so that drops issuing sequentially from the nozzle are never printed adjacent to one another. This is done by applying multiple voltage states to deflection electrodes in sequence and requires different voltage state waveforms dependent on the image sequence to be printed. V. Bischoff et al. in U.S. Pat. No. 3,827,057 and J. Zaretsky in U.S. Pat. No. 3,946,399 described arrangements for compensating the charge to be applied to a drop being formed to correct for the effects of the charge on the drop which was just previously formed by altering the voltage applied during formation of the present drop.

High speed and high quality inkjet printing requires that closely spaced drops of relatively small volumes are accurately directed to the receiving medium. Since ink drops are usually charged there are drop to drop interactions between adjacent drops from adjacent nozzles in a CIJ printer. These interactions can adversely affect drop placement and print quality. In electrostatic based CIJ printer systems using high density nozzle arrays the main source of drop placement error on a receiver is due to electrostatic interactions between adjacent charged print drops.

As the pattern of drops traverse from the printhead to the receiving medium (throw distance), through an electrostatic deflection zone, the relative spacing between the drops progressively changes depending on the print drop pattern. When closely spaced print drops from adjacent nozzles are similarly charged while traveling in air, electrostatic interactions will cause the spacing of these adjacent neighboring print drops to increase as the print drops travel toward the receiving medium. This results in printing errors which are observed as a spreading of the intended printed liquid pattern in an outward direction and are termed "splay" errors or cross-track drop placement errors herein. Since splay errors increase with increasing throw distance it is required that the throw distance be as short as possible which adversely affects print margin defined as the separation between print drops and gutter drops.

As such, there is an ongoing need to provide a high print resolution continuous inkjet printing system that electrostatically deflects selected drops using an individually addressable nozzle array and a common charge electrode with reduced drop placement errors caused by electrostatic interactions having a simplified design, improved print image quality and improved print margin.

SUMMARY OF THE INVENTION

It is an object of the invention to overcome at least one of the deficiencies described above by using mass charging and electrostatic deflection with a CMOS-MEMS printhead to create high resolution high quality prints while maintaining or improving drop placement accuracy and minimizing drop volume variation of printed drops.

The present invention improves CIJ printing by decreasing drop to drop electrostatic interactions, thus resulting in improved drop placement accuracy over previous CIJ printing systems. When two adjacent drops having opposite charge states on them are combined to form a print drop the combined charge will be lower on the print drops and close to 0 which will effectively remove most of the electrostatic interactions between adjacent print drops. The present invention also reduces the complexity of control signals sent to stimulation devices associated with nozzles of the nozzle array. This helps to reduce the complexity of charge electrode structures and enables using increased spacing between the charge electrode structures and the nozzles. The present invention also allows for longer throw distances by lowering the electrostatic interactions between adjacent print drops.

According to an aspect of the present invention, a method of ejecting liquid drops includes providing liquid under pressure sufficient to eject a liquid jet through a nozzle of a liquid chamber; input image data; a drop formation device; a velocity modulation device; a charging device; and a deflection device. The charging device includes a charge electrode associated with the liquid jet and a source of varying electrical potential between the charge electrode and the liquid jet. The drop formation device is associated with the liquid jet. A first catcher and a second catcher are provided. The first catcher is located on a first side of the liquid jet and the second catcher is located on a second side of the liquid jet.

The liquid jet is modulated using the drop formation device to cause portions of the liquid jet to break off into one or more clusters of drops traveling along a path with each cluster of drops being separated on average by a drop cluster period and each cluster of drops including a first drop and a second drop. A charging waveform is provided to the charge electrode of the charging device using the source of varying electrical potential of the charging device. The charging waveform includes a first voltage state and a second voltage state having opposing polarities when compared to each other; has a period that is equal to the drop cluster period; and is independent of the input image data. The charging device and the drop formation device are synchronized with each other to produce a first charge state on the first drop of each drop cluster and produce a second charge state on the second drop of each drop cluster. The first drop having a first charge state is caused to be deflected away from the path and toward the first catcher using the deflection device and the second drop having a second charge state is caused to be deflected away from the path and toward the second catcher using the deflection device. A relative velocity of the first drop and the second drop of a selected drop cluster is modulated using the velocity modulation device in response to input print data to cause the first drop and the second drop to form a merged drop traveling along the path. The merged drop has a third charge state that prevents the merged drop from being deflected to the first catcher by the deflection device and prevents the merged drop from being deflected to the second catcher by the deflection device.

According to another aspect of the present invention, a continuous liquid ejection system includes a liquid chamber in fluidic communication with a nozzle, the liquid chamber containing liquid under pressure sufficient to eject a liquid jet through the nozzle and a processor is configured to provide input image data. A drop formation device, associated with the liquid jet, modulates the liquid jet to cause portions of the liquid jet to break off into one or more clusters of drops traveling along a path with each cluster of drops separated on average by a drop cluster period and each cluster of drops including a first drop and a second drop. A charging device includes a charge electrode associated with the liquid jet; and a source of varying electrical potential between the charge electrode and the liquid jet that provides a charging waveform to the charge electrode. The charging waveform includes a first voltage state and a second voltage state having opposing polarities when compared to each other and a period that is equal to the drop cluster period. The charging waveform is independent of the input image data. The charging device and the drop formation device are synchronized to produce a first charge state on the first drop of each drop cluster and produce a second charge state on the second drop of each drop cluster.

A first catcher is located on a first side of the liquid jet and a second catcher located on a second side of the liquid jet. A deflection device causes the first drop having a first charge state to be deflected away from the path and toward the first catcher and the second drop having a second charge state being deflected away from the path and toward the second catcher. A velocity modulation device modulates a relative velocity of the first drop and the second drop of a selected drop cluster in response to input print data to cause the first drop and the second drop to form a merged drop traveling along the path. The merged drop includes a third charge state that prevents the merged drop from being deflected to the first catcher by the deflection device and prevents the merged drop from being deflected to the second catcher by the deflection device.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
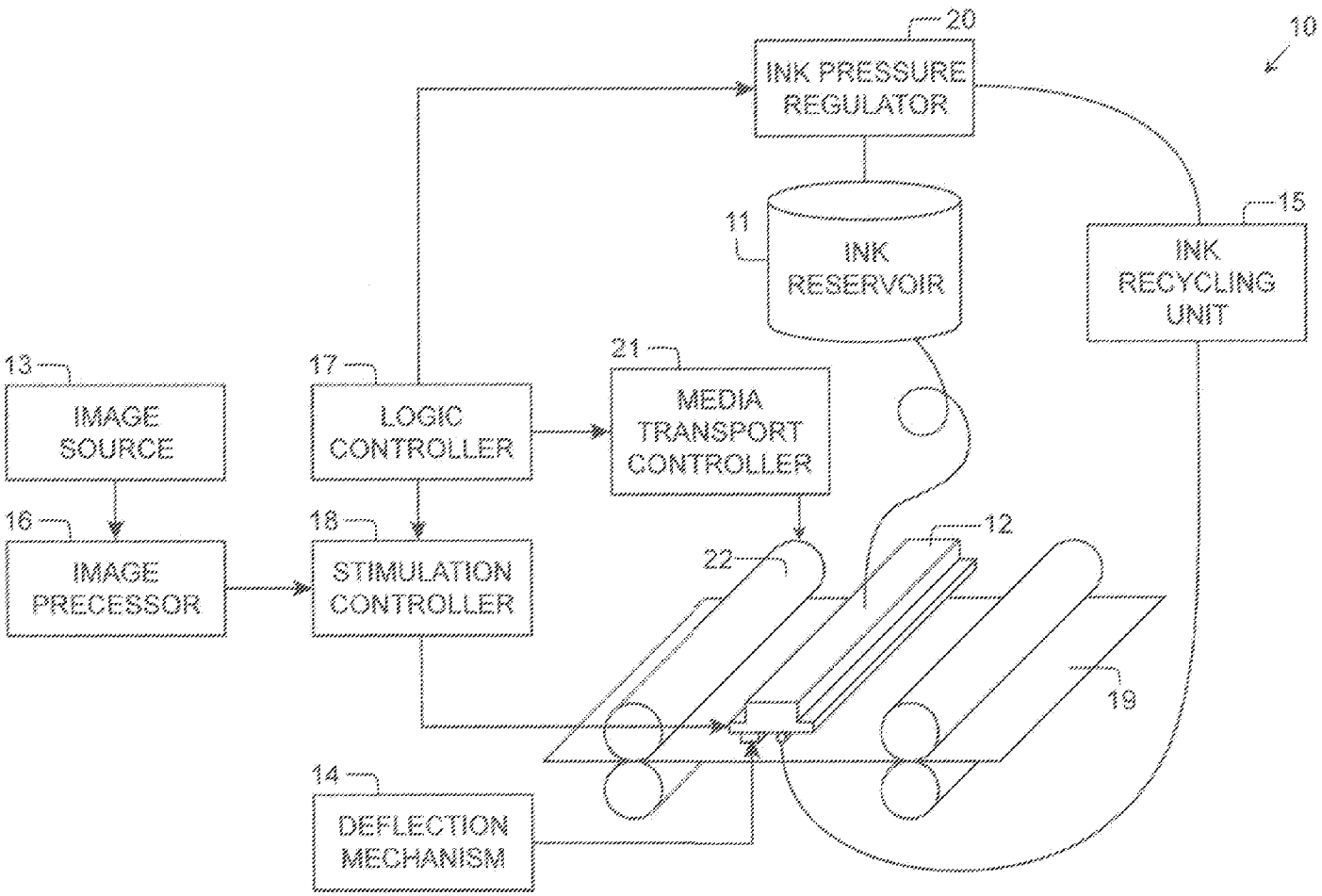
FIG. 1 is a simplified block schematic diagram of an exemplary continuous inkjet system according to the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, example embodiments of the present invention provide a printhead or printhead components typically used in inkjet printing systems. In such systems, the liquid is an ink for printing on a recording media. However, other applications are emerging, which use inkjet print heads to emit liquids (other than inks) that need to be finely metered and be deposited with high spatial resolution. As such, as described herein, the terms "liquid" and "ink" refer to any material that can be ejected by the printhead or printhead components described below.

Continuous ink jet (CIJ) drop generators rely on the physics of an unconstrained fluid jet, first analyzed in two dimensions by F. R. S. (Lord) Rayleigh, "Instability of Jets," Proc. London Math. Soc. 10 (4), published in 1878. Lord Rayleigh's analysis showed that liquid under pressure, P, will stream out of a hole, the nozzle, forming a liquid jet of diameter dj, moving at a velocity vj. The jet diameter dj is approximately equal to the effective nozzle diameter dn and the jet velocity is proportional to the square root of the reservoir pressure P. Rayleigh's analysis showed that the jet will naturally break up into drops of varying sizes based on surface waves that have wavelengths $\lambda$ longer than $\pi$dj, i.e. $\lambda \geq \pi dj$. Rayleigh's analysis also showed that particular surface wavelengths would become dominate if initiated at a large enough magnitude, thereby "stimulating" the jet to produce mono-sized drops. Continuous ink jet (CIJ) drop generators employ a periodic physical process, a so-called "perturbation" or "stimulation" that has the effect of establishing a particular, dominate surface wave on the jet. The stimulation results in the break off of the jet into mono-sized drops synchronized to the fundamental frequency of the perturbation. It has been shown that the maximum efficiency of jet break off occurs at an optimum frequency $F_{opt}$ which results in the shortest time to break off. At the optimum frequency $F_{opt}$ (optimum Rayleigh frequency) the perturbation wavelength $\lambda$ is approximately equal to 4.5 dj. The frequency at which the perturbation wavelength $\lambda$ is equal to $\pi$dj is called the Rayleigh cutoff frequency $F_{R.}$ since perturbations of the liquid jet at frequencies higher than the cutoff frequency won't grow to cause a drop to be formed.

The drop stream that results from applying Rayleigh stimulation will be referred to herein as creating a stream of drops of predetermined volume. While in prior art CIJ systems, the drops of interest for printing or patterned layer deposition were invariably of unitary volume, it will be explained that for the present inventions, the stimulation signal can be manipulated to produce drops of predetermined multiples of the unitary volume. Hence the phrase, "streams of drops of predetermined volumes" is inclusive of drop streams that are broken up into drops all having one size or streams broken up into drops of planned different volumes.

In a CIJ system, some drops, usually termed "satellites" much smaller in volume than the predetermined unit volume, can be formed as the stream necks down into a fine ligament of fluid. Such satellites may not be totally predictable or may not always merge with another drop in a predictable fashion, thereby slightly altering the volume of drops intended for printing or patterning. The presence of small, unpredictable satellite drops is, however, inconsequential to the present invention and is not considered to obviate the fact that the drop sizes have been predetermined by the synchronizing energy signals used in the present invention. Drops of predetermined volume each have an associated portion of the drop forming waveform responsible for the creation of the drop. Satellite drops don't have a distinct portion of the waveform responsible for their creation. Thus the phrase "predetermined volume" as used to describe the present invention should be understood to comprehend that some small variation in drop volume about a planned target value may occur due to unpredictable satellite drop formation.

The example embodiments discussed below with reference to FIGS. 1-11 are described using particular combinations of components, for example, particular combinations of drop charging structures, drop deflection structures, drop catching structures, drop formation devices, and drop velocity modulating devices. It should be understood that these components are interchangeable and that other combinations of these components are within the scope of the invention.

Figure 2:
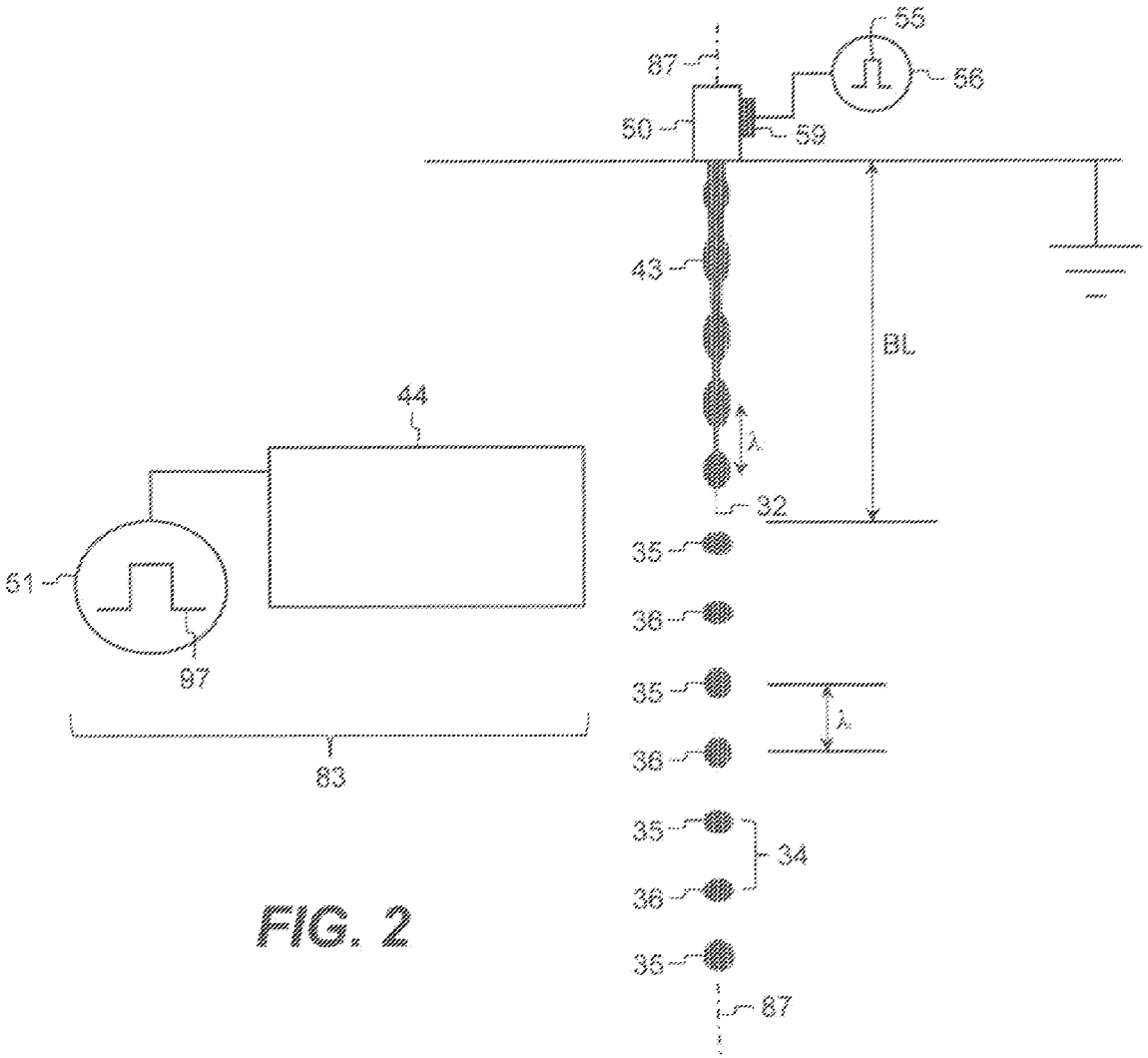
FIG. 2 shows an image of a liquid jet being ejected from a drop generator and its subsequent break off into drops at its fundamental period $\tau_o$ having a drop spacing $\lambda$.

A continuous inkjet printing system 10 is illustrated in FIG. 1, and FIG. 2 shows an image of a liquid jet 43 being ejected from a single drop generator of a printhead 12 and its subsequent break off into drops 35 and 36 at its fundamental period $\tau_o$ having an adjacent drop spacing $\lambda$. The continuous inkjet printing system 10 includes an ink reservoir 11 that continuously pumps ink into a printhead 12 also called a liquid ejector or drop generator to create a continuous stream of ink drops. Printing system 10 receives digitized image process data from an image source 13 such as a scanner, computer or digital camera or other source of digital data which provides raster image data, outline image data in the form of a page description language, or other forms of digital image data. The image data from the image source 13 is sent periodically to an image processor 16. Image processor 16 processes the image data and includes a memory for storing image data. The image processor 16 is typically a raster image processor (RIP), which converts the received image data into print data, a bitmap of pixels for printing. The print data is sent to a stimulation controller 18, which generates stimulation waveforms 55; patterns of time-varying electrical stimulation pulses to cause a stream of drops to form at the outlet of each of the nozzles on printhead 12, as will be described. These stimulation pulses are applied at an appropriate time and at an appropriate frequency to stimulation device(s) 59 associated with each of the nozzles 50 with appropriate amplitudes, duty cycles, and timings to cause drops 35 and 36 to break off from the continuous stream 43. The printhead 12 and deflection mechanism 14 work cooperatively in order to determine whether ink droplets are printed on a recording medium 19 in the appropriate position designated by the data in image memory, or deflected and recycled via the ink recycling unit 15. The recording medium 19 is also called a receiver and it is commonly composed of, but not limited to, paper, polymer, or some other substrate. The ink in the ink recycling unit 15 is directed back into the ink reservoir 11. The ink is distributed under pressure to the back surface of the printhead 12 by an ink channel that includes a chamber or plenum formed in a substrate typically constructed of silicon. Alternatively, the chamber could be formed in a manifold piece to which the silicon substrate is attached. The ink preferably flows from the chamber through slots and/or holes etched through the silicon substrate of the printhead 12 to its front surface, where a plurality of nozzles and stimulation devices are situated. The ink pressure suitable for optimal operation will depend on a number of factors, including geometry and thermal properties of the nozzles and thermal and fluid dynamic properties of the ink. The constant ink pressure can be achieved by applying pressure to ink reservoir 11 under the control of ink pressure regulator 20, or by means of a liquid pump that pumps the liquid under pressure from the ink reservoir 11 to the printhead 12. The deflection mechanism 14 is an electrostatic drop deflection mechanism.

The RIP or other type of processor 16 converts the image data to a pixel-mapped image page image for printing. Image data can include raw image data, additional image data generated from image processing algorithms to improve the quality of printed images, and data from drop placement corrections, which can be generated from many sources, for example, from measurements of the steering errors of each nozzle in the printhead 12 as is well-known to those skilled in the art of printhead characterization and image processing. The information in the image processor 16 thus can be said to represent a general source of data for drop ejection, such as desired locations of ink droplets to be printed and identification of those droplets to be collected for recycling.

During printing, recording medium 19 is moved relative to printhead 12 by means of a media transport system 22 which are electronically controlled by media transport controller 21. A logic controller 17, preferably micro-processor based and suitably programmed as is well known, provides control signals for cooperation of transport controller 21 with the ink pressure regulator 20 and stimulation controller 18. The stimulation controller 18 comprises one or more stimulation waveform sources 56 that generate drop formation waveforms in response to the print data and provide or applies the drop formation waveforms 55, also called stimulation waveforms, to the stimulation device(s) 59 also called drop formation device(s) 59 associated with each nozzle 50 or liquid jet 43. In response to the energy pulses of applied stimulation waveforms, the drop formation device 59 perturbs the continuous liquid stream 43, also called a liquid jet 43, to cause individual liquid drops to break off from the liquid stream. The drops break off from the liquid jet 43 at a distance BL from the nozzle plate. The information in the image processor 16 thus can be said to represent a general source of data for drop formation, such as desired locations of ink droplets to be printed and identification of those droplets to be collected for recycling.

It can be appreciated that different mechanical configurations for media transport systems 19 can be used. For example, in the case of a page-width printhead, it is convenient to move recording medium 19 pasta stationary printhead 12. On the other hand, in the case of a scanning-type printing system, it is more convenient to move a printhead along one axis (i.e., a main-scanning direction) and move the recording medium along an orthogonal axis (i.e., a sub-scanning direction), in relative raster motion.

Drop forming pulses are provided by the stimulation controller 18, which can be generally referred to as a drop controller, and are typically voltage pulses sent to the printhead 12 through electrical connectors, as is well-known in the art of signal transmission. However, other types of pulses, such as optical pulses, can also be sent to printhead 12, to cause printing and non-printing drops to be formed at particular nozzles, as is well-known in the inkjet printing arts. Once formed, printing drops travel through the air to a recording medium and later impinge on a particular pixel area of the recording medium or are collected by a catcher as will be described.

Referring to FIG. 2 the printing system has associated with it, a printhead 12 that is operable to produce from an array of nozzles 50 an array of liquid jets 43. The array of nozzles extends in and out of the FIG. 2. Associated with each liquid jet 43 are a drop formation device 59 and a drop formation waveform source 56 that supplies a stimulation waveform 55, also called a drop formation waveform, to the drop formation device. The drop formation device 59, commonly called a drop formation transducer or a stimulation transducer, can be of any type suitable for creating a perturbation on the liquid jet, such as a thermal device, a piezoelectric device, a MEMS actuator, an electrohydrodynamic device, an optical device, an electrostrictive device, and combinations thereof.

Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop formation waveform source 56 supplies a drop formation waveform having a fundamental frequency $f_o$ and a fundamental period of $\tau_o=1/f_o$ to the drop formation transducer, which produces a modulation with a wavelength $\lambda$ in the liquid jet. The modulation grows in amplitude to cause portions of the liquid jet break off into drops. Through the action of the drop formation device, a sequence of drops are produced at a fundamental frequency $f_o$ with a fundamental period of $\tau_o=1/f_o$.

In FIG. 2, liquid jet 43 breaks off into drops with a regular period at break off location 32, which is a distance BL from the nozzle 50. The distance between a pair of successive drops 35 and 36 is essentially equal to the wavelength $\lambda$ of the perturbation on the liquid jet. The pair of successive drops 35 and 36 that break off from the liquid jet forms is called a drop cluster 34, each drop cluster having a first drop 36 and a second drop 35. Thus, the frequency of formation of drop cluster 34, commonly called the drop cluster frequency $f_p$, is given by $f_p=f_o/2$ and the corresponding drop cluster period is $\tau_p=2\tau_o$. Usually the drop stimulation frequency of the stimulation transducers for the entire array of nozzles 50 in a printhead is the same for all nozzles in the printhead 12.

Also shown in FIG. 2 is a charging device 83 comprising charge electrode 44 and charging voltage source 51. The charging voltage source 51 supplies a charge electrode waveform 97 which controls the voltage signal applied to the charge electrode. The charge electrode 44 is associated with the liquid jet and is positioned adjacent to the break off point 32 of the liquid jet 43. When a non-zero voltage is applied to the charge electrode 44, an electric field is produced between the charge electrode and the electrically grounded liquid jet. The capacitive coupling between the charge electrode and the electrically grounded liquid jet induces a net charge on the end of the electrically conductive liquid jet. (The liquid jet is grounded by means of contact with the liquid chamber of the grounded drop generator.) If the end portion of the liquid jet breaks off to form a drop while there is a net charge on the end of the liquid jet, the charge of that end portion of the liquid jet is trapped on the newly formed drop. When the voltage level on the charge electrode is changed, the charge induced on the liquid jet changes due to the capacitive coupling between the charge electrode and the liquid jet. Hence, the charge on the newly formed drops can be controlled by varying the electric potential on the charge electrode.

Figure 3:
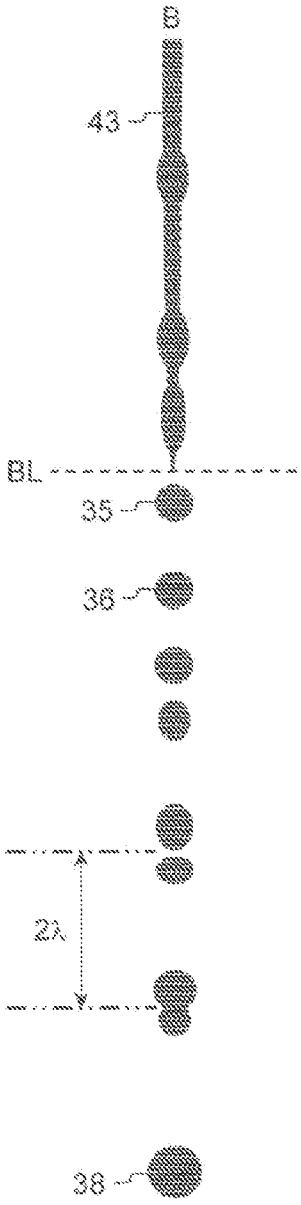
FIG. 3 shows images of liquid jets being ejected from a drop generator and its subsequent break off into drop pairs which later combine to form merged drops.

The drop formation dynamics of drops forming from a liquid stream being jetted from an inkjet nozzle can be varied by altering the waveforms applied to the respective drop formation transducer associated with a particular nozzle orifice. Changing at least one of the amplitude, duty cycle or timing relative to other pulses in the waveform or in a sequence of waveforms can alter the drop formation dynamics of a particular nozzle orifice. It has been found that the drop forming pulses of the drop formation waveform can be adjusted modulate the velocity of consecutive drops 35 and 36 in a drop cluster 34 such that the drops in the drop cluster merge to form a merged drop 38 as shown in FIG. 3. The large drops 38, formed by the merging of the drops in the drop cluster are produced at half the fundamental frequency; the drop cluster period $\tau_p$ is given by $\tau_p=2\tau_o$. The average spacing between adjacent large drops is $2\lambda$. Whether the velocity of the drops in the drop cluster have been modulated to cause the drops to merge to form a large drop 38 as shown in FIG. 3, or the drops are formed without velocity modulation, so that they don't merge as shown in FIG. 2, the breakoff lengths BL are similar.

In various embodiments of this invention, the voltage on the charging electrode 44 is controlled by the charging pulse source 51 which provides a two voltage state waveform operating at the charging waveform frequency $f_{cw}$. In FIG. 7B, the charging waveform frequency is equal to the drop cluster frequency, which is at half the fundamental frequency $f_o$. The two voltage state charging waveform produces two distinct charge states on successively formed drops 36 and 35 of drop clusters 34. Thus, the charging pulse voltage source 51 provides a varying electrical potential between the charging electrode 44 and the liquid jet 43. The source of varying electrical potential generates a charge electrode waveform 97, the charge electrode waveform has a period that is equal to the drop cluster period, and the charge electrode waveform includes a first distinct voltage state and a second distinct voltage state. The timing of the stimulation waveforms applied to the drop formation devices and the timing of the charging pulse source applied to the charge electrode are synchronized so that the first drop 36 of a drop cluster breaks off during the first voltage state and produces a first charge state on the first drop, and the second drop 35 of the drop cluster breaks off during the second voltage state and produces a second charge state on the second drop of the drop cluster. In the practice of this invention drops 36 and 35 of selected drop clusters are made to subsequently merge to form merged drops 38 which have a third charge state. In all embodiments of this invention the minimum time interval between successive print drops is $2\tau_o$ which is equal to a drop cluster period. The drop cluster period is also equal to the charge electrode stimulation waveform period. The drop cluster period is also called the print cycle. The print cycle is defined as the minimum time interval in which successive print drops can be printed using the embodiments of the invention.

In the printer, sequences of print or non print drops are generated in response to the input image data. During printing, communication signals from the stimulation controller 18 applied to the drop formation stimulation waveform source 56 are used to determine the order of formation of print and non-print drops, and the waveform source 56 provides different print drop and non-print drop stimulation waveforms 55 to the drop formation device. In the practice of this invention, the merged drops 38 are print drops and the non merged first and second drops 35 and 36 drops are non-print drops. Thus, the selected drop clusters correspond to print drops in the image data.

The liquid jets are modulated using the drop formation device to selectively cause portions of the liquid jet to break off into one or more clusters of drops traveling along a path using the drop formation device associated with the liquid jet, each cluster of drops separated on average by a drop cluster period, each cluster of drops including a first drop 36 and a second drop 35 in response to the input image data. When the input image data calls for a print drop to be formed, the drop forming waveform is selected or modified such that the first and second drops of the drop cluster are made to combine (merge) with each other to form a merged drop 38 as shown in FIG. 3, using a drop merging mechanism which is also associated with the liquid jets. The drop merging mechanism varies the velocity of the first and second drops of a drop cluster relative to each other so that they merge. The drop merging mechanism can comprise a drop velocity modulation transducer 41 that is distinct from the drop forming transducer 59 as shown in FIG. 4, or a drop velocity modulation transducer that is the same transducer as the drop forming transducer as shown in FIG. 5.

In an alternate embodiment the cluster of drops includes a third drop 49 in addition to first drop 36 and second drop 35. This example embodiment of the invention is described in more detail with reference to FIG. 8. In this alternate embodiment the drop cluster period is 3 fundamental drop fundamental periods long, and print drops are still formed by the merging of first drop 36 and second drop 35. Drops 36, drops 35 and drops 49 are not printed.

As stated above a drop merging mechanism comprises a drop velocity modulation transducer associated with the liquid jet. The drop velocity modulation transducer can be one of a thermal device, a piezoelectric device, a MEMS actuator, an electrohydrodynamic device, an optical device, an electrostrictive device, and combinations thereof. Depending on the type of transducer used, the transducer can be located in or adjacent to the liquid chamber that supplies the liquid to the nozzles to act on the liquid in the liquid chamber, be located in or immediately around the nozzles to act on the liquid as it passes through the nozzle, or located adjacent to the liquid jet to act on the liquid jet after it has passed through the nozzle. The drop velocity modulation device is employed to alter or modulate the velocity of the first drop, the second drop, or both drops in a drop cluster to cause the first and second drop in a drop cluster to merge. As small changes in the amplitude, the duty cycle and waveform timing of the energy pulses transferred to the liquid jet to form the drops affect the velocity of the formed drops, the velocity of one or both drops in a drop cluster can be modulated and is accomplished by altering the characteristics of the energy transferred to the liquid jet that create the perturbations on the liquid jet that cause the drops to break off from the liquid stream. The drop velocity modulation waveform depends on the print or image data and is only applied when drop clusters are produced.

Figure 4:
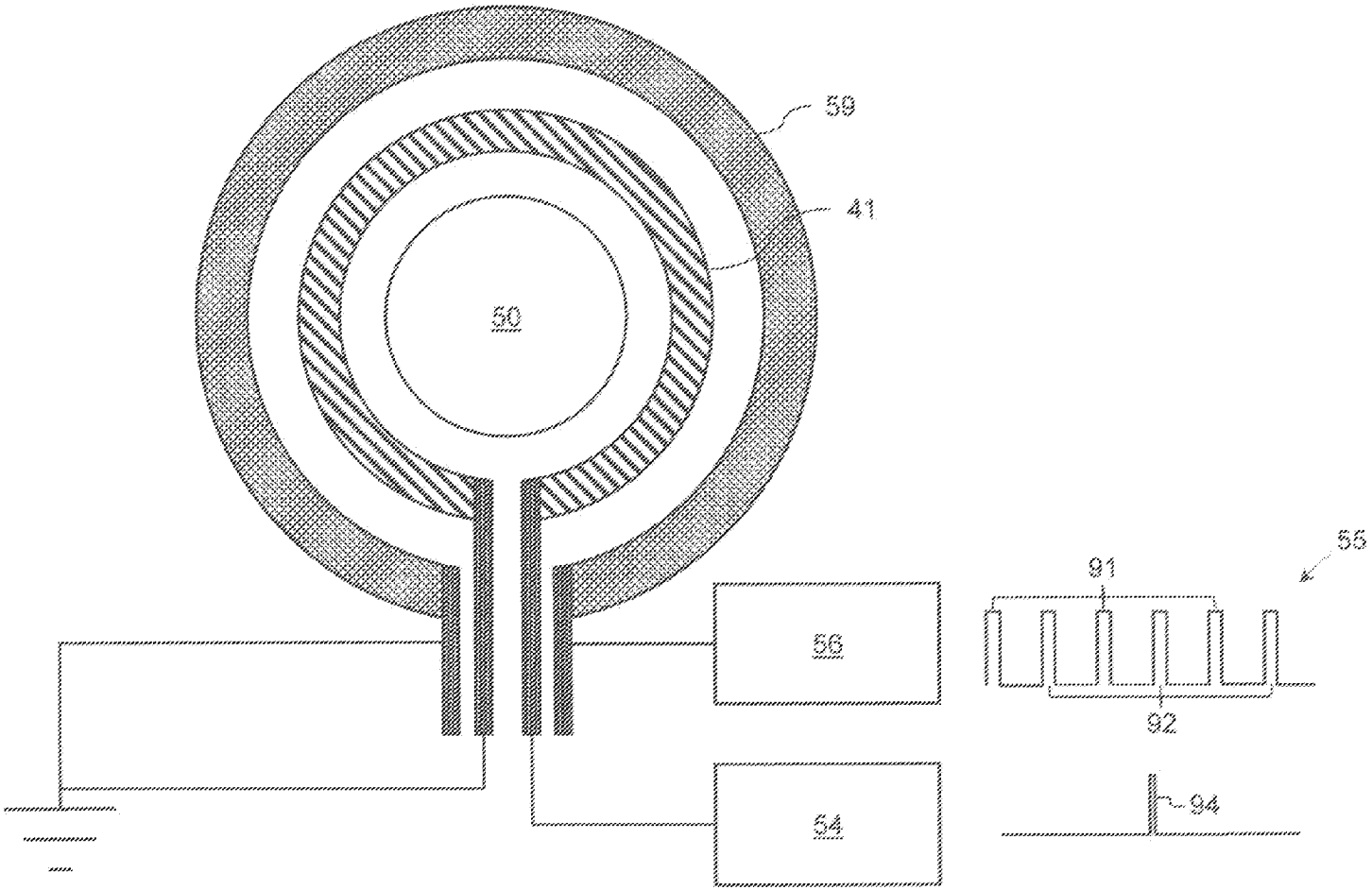
FIG. 4 is a simplified block schematic diagram of a nozzle and associated drop formation device and velocity modulation device according to an example embodiment of the invention.
Figure 5:
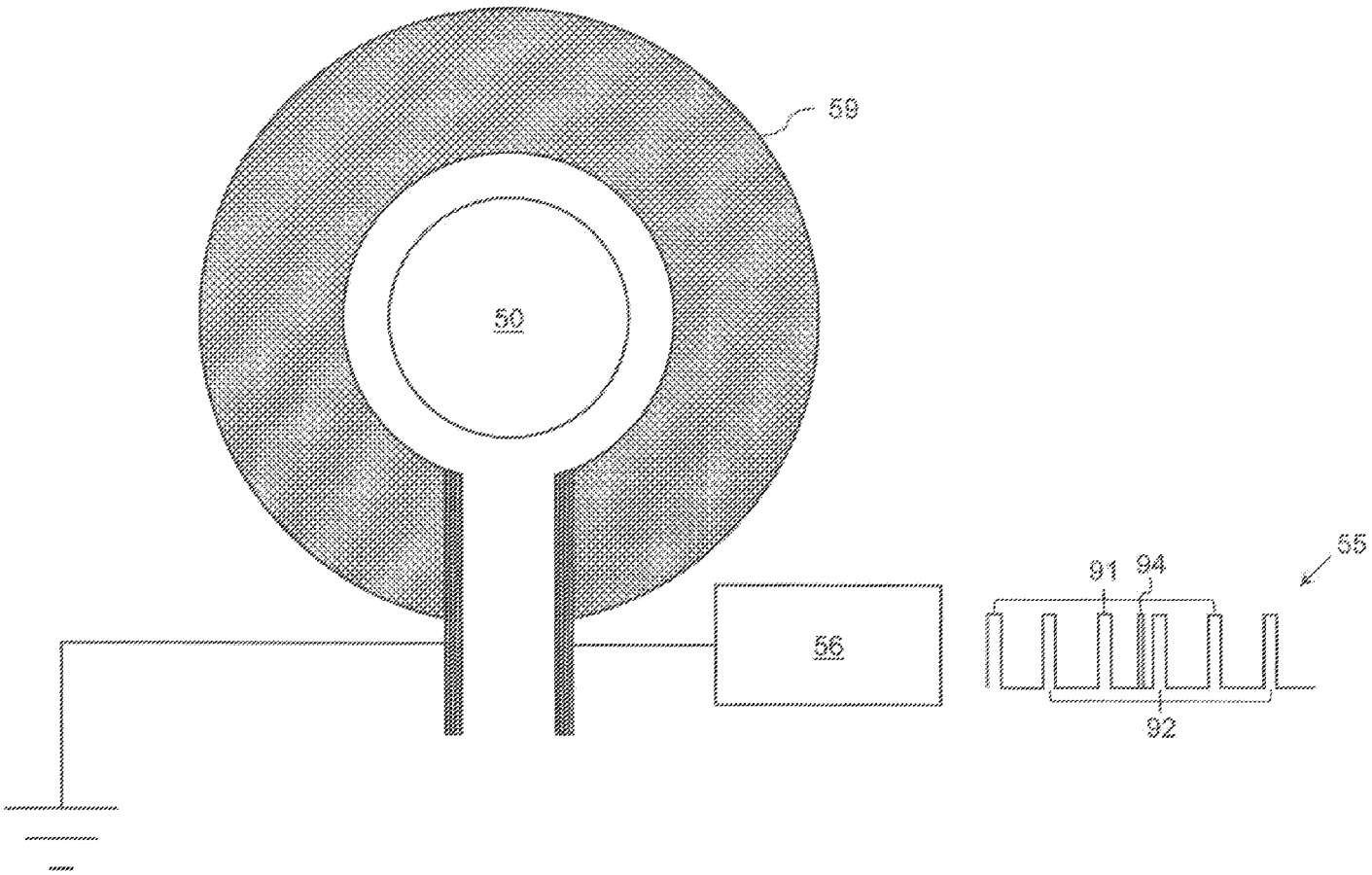
FIG. 5 is a simplified block schematic diagram of a nozzle and an associated stimulation device according to another example embodiment of the invention.

FIG. 4 and FIG. 5 show example embodiments of the invention showing suitable drop merging mechanisms using velocity modulation pulses and thermal actuators. FIG. 4 shows an example in which the needed small changes in the amplitude, the duty cycle, and waveform timing of the energy pulses transferred to the liquid jet to affect the velocity of the formed drops are provided by means of a separate velocity modulation device transducer 41 while FIG. 5 shows an example in which the needed small changes in the amplitude, the duty cycle, and waveform timing of the energy pulses transferred to the liquid jet to affect the velocity of the formed drops are provided by modifying the pulses applied to the drop formation transducer or stimulation transducer 59. In the configuration shown in FIG. 4 the velocity modulation device transducer 41 and the drop formation device transducer 59 are separate heaters concentrically placed around the nozzle 50. The drop formation waveform source 56 supplies an image-data dependent drop stimulation waveform 55 made up of a sequence of voltage pulses to the drop stimulation transducer 59 which causes modulation in the liquid jet flowing through the nozzle 50 in response to the input image data. An image data dependent sequence of drop velocity modulating pulses 94 is applied to the drop velocity modulation device transducer 41 by the velocity modulation source 54. When drop velocity modulating pulses 94 and the drop stimulation waveform 55 pulses are provided by different waveform sources, the drop stimulation waveform source can supply an image-data independent drop stimulation waveform 55. The short sequence of voltage pulses making up the drop stimulation waveform 55 consisting of first drop forming pulses 91 and second drop forming pulses 92 is shown for the case of 3 successive drop clusters s. The timing of the drop velocity modulating pulses 94 applied to the drop velocity modulation device transducer 41 is such that the second drop 35 of a drop cluster 34 is faster than the first drop 36, which will cause the second drop to overtake and subsequently merge with each the first drop as they travel along an initial path 87. When the first drop and the second drops are charged to opposing polarities, the electrostatic attraction between the two drops can help accelerate the first and second drops toward each other.

In the embodiment shown in FIG. 5, the drop stimulation transducer 59 and the drop velocity modulation device are the same device. Image-data dependent drop stimulation waveforms 55 made up of sequences of voltage pulses supplied by the drop stimulation waveform source 56 are applied to the drop stimulation transducer 59 which causes modulation in the liquid jet flowing through the nozzle 50 in response to the input image data. The short sequence of voltage pulses making up the drop stimulation waveform 55 is shown for the example of a sequence of a non-print pixel, followed by a print pixel, followed by a non-print pixel. For the non-print pixels the waveform includes a first drop forming pulse 91 and a second drop forming pulse 92. For the print pixel the waveform includes a first drop forming pulse 91 and a second drop forming pulse 92, with a velocity modulating pulse 94 between them. This short pulse 94 is lacks sufficient energy to cause a drop to break off, but tends to accelerate the second drop of the drop cluster.

Figure 6:
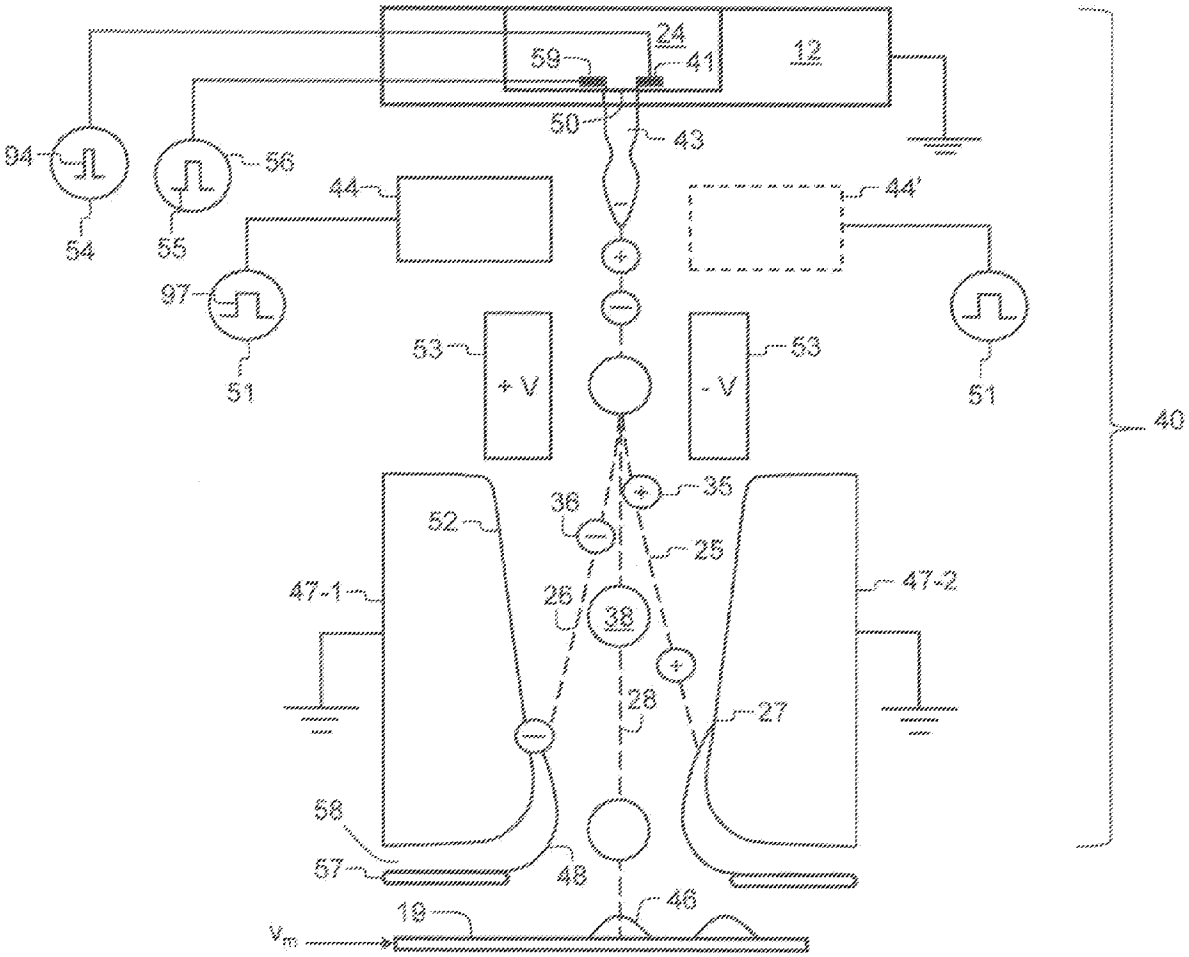
FIG. 6 shows a cross sectional viewpoint through a liquid jet of a first embodiment of the continuous liquid ejection system according to this invention and illustrates a general print condition.

FIG. 6 shows a cross sectional view through an embodiment of continuous liquid ejection systems 40 used in the practice of this invention. In this figure, the array of nozzles is aligned into and out of the figure. FIG. 6 shows an embodiment of the continuous liquid ejection system according to this invention operating in a general print condition. In the general print condition, some drops are formed for printing while other drops are formed to be caught, as called for by the print data.

In the various embodiments of the invention, the continuous liquid ejection system 40 includes a printhead 12 comprising a liquid chamber 24 in fluid communication with an array of one or more nozzles 50 for emitting liquid jets 43. Liquid is supplied under a pressure sufficient to eject liquid jets through the nozzles of the liquid chamber. Associated with each liquid jet is a stimulation transducer 59. In the embodiments shown, the stimulation transducer 59 is formed in the wall around the nozzle 50. Separate stimulation transducers 59 can be integrated with each of the nozzles in a plurality of nozzles. The stimulation transducer 59 is actuated by a drop formation waveform source 56 which provides the periodic stimulation of the liquid jet 43 in the form of drop stimulation waveforms which are dependent on the input image data. In these embodiments, the periodic stimulation of the liquid jets 43 causes the jets to break off into sequences of drop clusters 34 traveling along a path, or into sequences of drop clusters that merge to form merged drops 38 travelling along the path. The embodiment shown in FIG. 6 includes a separate drop velocity modulation transducer 41 surrounding each of the nozzles 50. A velocity modulation source 54 supplies drop velocity modulating pulses 94 to the drop velocity modulation transducers 41 as described previously.

The energy of the stimulation waveforms applied to the liquid jets is controlled so that all drops break off from the liquid stream 43 adjacent to the charge electrode 44 which is common to all of the nozzles of the plurality of nozzles in the printhead 12. The charging waveform source 51 supplies a time varying electrical potential (charge electrode waveform 97) between the charging electrode 44 and the liquid jet 43 which is usually grounded. The charge electrode waveform has a period, called the charging waveform period and includes a first distinct voltage state and a second distinct voltage state. The timing of the stimulation waveforms applied to the drop formation devices and the timing of the charging pulse source applied to the charge electrode are synchronized to produce a first charge state on the first drop 36 of a drop cluster indicated by a negative sign and a second charge state on the second drop 35 of a drop cluster indicated by a positive sign. When the velocity of the first and second drops of the drop cluster are modulated, the second drops 35 and first drops 36 of drop clusters are subsequently merged to form merged drops 38, having a third charge state shown as having neutral charge. Preferably the third charge state is a zero or near zero net charge state. FIG. 6 also shows an optional symmetric charge electrode 44' shown in a dotted outline which is preferably located at the same height and same distance from the liquid jet as charge electrode 44. The optional symmetric charge electrode 44' is supplied with the same charge electrode waveform 97 from the same charging waveform source 51 supplied to charge electrode 44. During operation, it is desirable to adjust the voltage levels of the two state charge electrode waveform so that the first drop 36 of a drop cluster and the second drop 35 of a drop cluster 34 have equal and opposite charge levels on them. When this is accomplished the merged drop 38 will have no net charge on it.

The first, second and merged drops, 35, 36, and 38 pass between optionally provided deflection electrodes 53. The voltage between the deflection electrodes produces an electric field in the space between the electrodes that causes negatively charged drops to be deflected toward the one catcher 47-1 as they travel along the negatively charged drop trajectory 26, while the positively charged drops are deflected toward the other catcher 47-2 as they travel along the positively charged drop trajectory 25. The merged drops 38, having zero charge are undeflected, travel along merged drop trajectory 28, passing both catchers to strike the print media 19. In the embodiment shown, the deflection electrodes are biased to approximately equal and opposite voltages relative to the grounded drop generator. This reduces the amount of charge induced on the drops as they break off due to the electric fields produced by the deflection electrodes. While the deflection mechanism shown here is made up of two deflection electrodes, other deflection mechanisms can be used. For example, instead of using deflection electrodes that are distinct from both the charge electrodes and the catcher, alternate configurations include configurations in which the two catchers are biased to different voltages such that the electric field between the catchers deflects the charged drops such that some drops are deflected to one of the catchers and the oppositely charged drops are deflected to the other catcher.

The drops that strike either catcher form a liquid film 48 on the catcher face; the liquid film flows down the catcher face 52 and into the liquid recovery channel 58. Liquid from the liquid recovery channel 58 is typically returned to the ink reservoir 11 via the ink recycling unit 15. While Coanda catchers are shown, other catcher types, such as a knife edge catcher can be used.

The relatively non-charged merged drops are printed and highly charged drops are guttered and recycled. Due to the minimal charge on print drops they will travel along a trajectory which is substantially coincident with the initial path. When print drops contact the recording medium 19 while it is moving at a relative velocity $v_m$ with respect to the printhead 12 they form printed drops 46 on the recorded medium in regions corresponding to the input image data.

In practice, the print drops may be slightly deflected away from the catcher and allowed to hit the recording medium. For proper operation of the printhead 12 shown in FIG. 6, the catcher 47 and/or the catcher bottom plate 57 are grounded to allow the charge on the intercepted drops to be dissipated as the ink flows down the catcher face 52 and enters the ink return channel 58. Charged third drops 49 are attracted to catcher face 52 of grounded catcher 47 and intercept the catch face 52 at charged drop catcher contact location 27 to form an ink film 48 traveling down the face of the catcher 47. The bottom of the catcher face has a curved surface, around which ink can flow from the catcher face 52 into the ink recovery channel 58. The ink recovery channel 58 is formed between the bottom of the catcher body and the bottom catcher plate 57 for capturing and recirculation of the ink in the ink film 48. If a positive voltage potential difference exists from the electrode 44 to the liquid jet 43 at the time of break off of a drop breaking off adjacent to the electrode, a negative charge will be induced on the forming drop that will be retained after break off of the drop from the liquid jet. Similarly, if a negative voltage potential difference exists from the electrode 44 to the liquid jet 43 at the time of break off of a drop breaking off adjacent to the electrode, a positive charge will be induced on the forming drop that will be retained after break off of the drop from the liquid jet. In some embodiments, drop 36 is made to break off when there is a positive potential difference between the electrode 44 and the liquid jet 43, and drop 35 is made to break off when there is a negative potential difference between the electrode 44 and the liquid jet 43 which causes drop 36 to have a negative charge and drop 35 to have a positive charge. In other embodiments the polarities are reversed. Thus these two drops undergo electrostatic attraction which tends to help these drops merge into merged drop 38.

Figure 7:
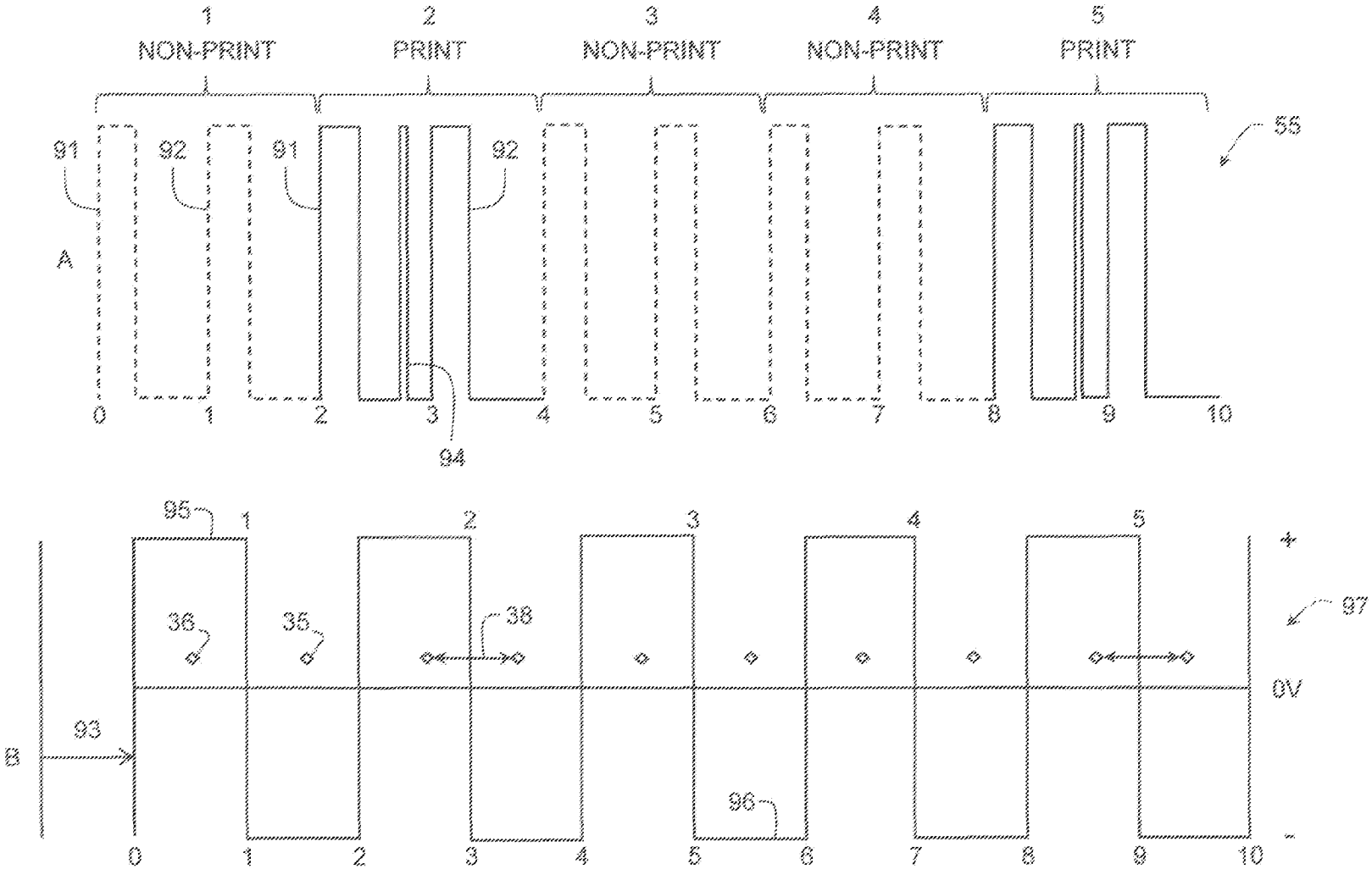
FIG. 7 shows an embodiment of a timing diagram illustrating drop formation pulses (A), the charge electrode waveform and the break off of drops (B) and the velocity modulating pulses (C), printing at a first speed.

FIG. 7 shows timing diagrams of an embodiment illustrating drop formation waveforms 55, including drop forming pulses 91 and 92 and velocity modulating pulses 94 in A, and charge electrode waveforms 97, and break off timing of drops for the drops formed by the illustrated drop formation waveform as a function of time for 5 successive drop cluster cycles in B. In these plots merged drops 38, which are printed, are formed from drops 35 and 36 that break off during the second and the fifth drop cluster cycles, while non-merging first and second drops 35 and 36 that break off during drop cluster cycles 1, 3, and 4 are not printed. In order to properly synchronize the break off of drops with the electrode voltage level a phase delay time 93 is utilized. In this case, the drop formation transducer and the velocity modulation transducer comprise the same transducer as shown in FIG. 5. FIG. 7 shows an example timing diagram illustrating drop formation and velocity modulating pulses applied to a thermal actuator based printhead in section (A) with the timing of the charge electrode waveform and the break off timing of drops in section (B). The velocity modulating pulses 94 and the drop formation pulses 91 and 92 are applied to the same drop formation transducer thermal actuator from the same waveform source. In this case, during the non-print drop cluster cycles 1,3, and 4, the non-print drop forming pulses 91 and 92 is shown to break off as two drops 35 and 36 which do not merge as they travel down the initial path as shown in FIG. 2. During the print drop cluster cycles 2 and 5 the pair of heater voltage pulses 91 and 92 are applied to the drop formation transducer to cause the break off of a first drop 36 and a second drop 35 and the very short velocity modulation pulse 94 is applied after the first drop forming voltage pulse 91 and before the second drop forming voltage pulse 92 to cause first drop 36 and second drop 35 to subsequently merge to form drop 38; the merging denoted by the double headed arrow.

In the illustrated drop charging waveforms of FIG. 7, the second voltage state 96 has a voltage of approximately the same amplitude, but opposite sign to the first voltage state 95, causing the second drop 35 will have a charge that is approximately the same amplitude, but of opposite sign to the first drop 36. When these two drops merge to form a large drop 38, the large drop will then have approximately zero charge. The printing system can include a drop charge sensor to determine the charge of the merged drops. Based on the measured charge, the control can make voltage adjustments to one or both of the first and the second voltage states to drive the charge of the merged drop closer to zero. This can be beneficial as lower charge amplitudes on the print drops reduce the electrostatic drop-drop interactions that can affect drop placement accuracy on the print media.

Figure 8:
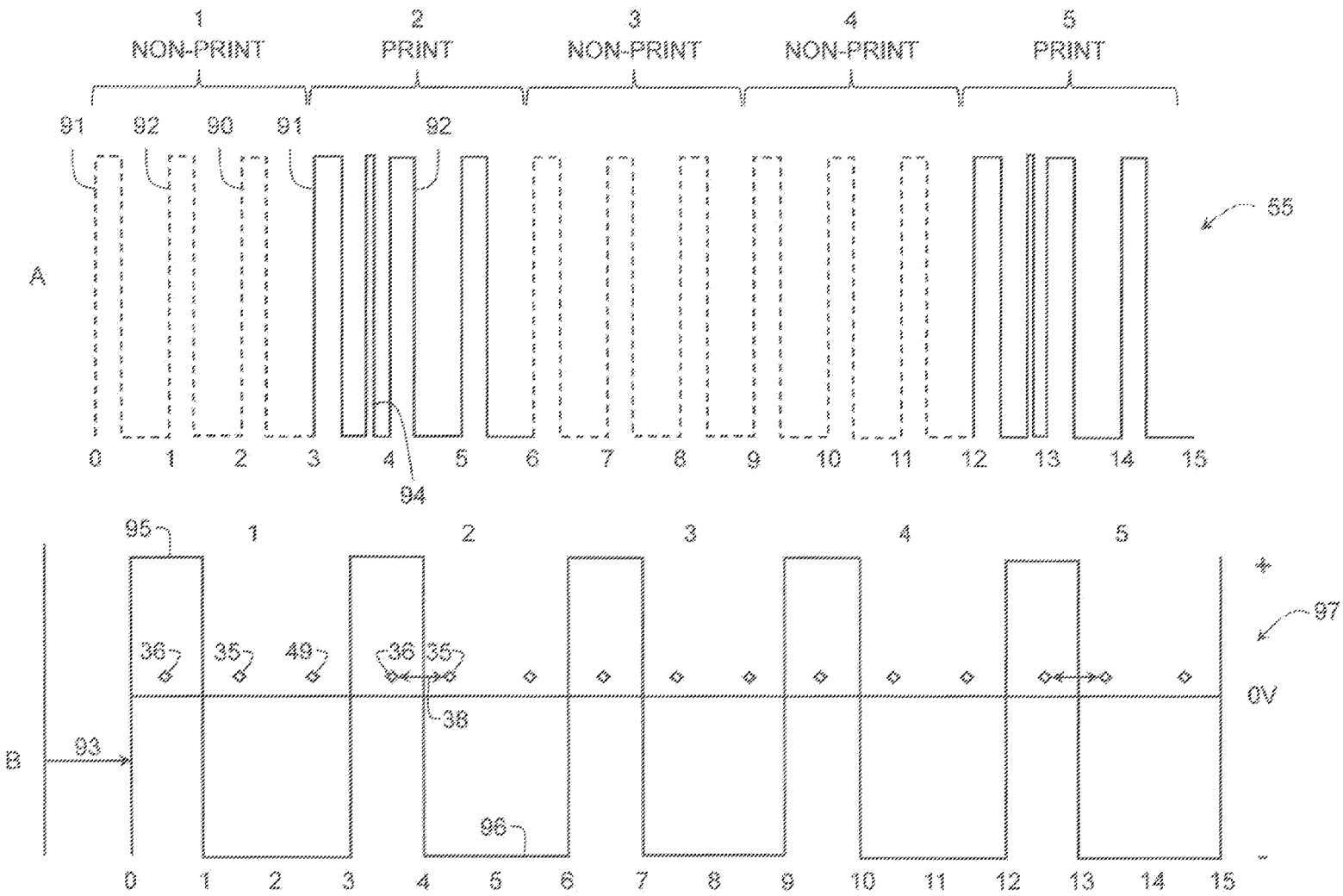
FIG. 8 shows an embodiment of a timing diagram illustrating drop formation pulses, velocity modulating pulses (A) and the charge electrode waveform, and the break off of drops (B), printing at a second speed.

Section B of FIG. 8 shows a timing diagram of an alternate embodiment of this invention showing the charge electrode waveform as function of drop cluster cycle number along with the break off timing of drops. In this embodiment, each drop cluster is made up of three drops: a first drop 35, a second drop 36, and a third drop 49. The drop formation waveforms that generate the break off timing are shown in section A of FIG. 8. In this embodiment, the charge electrode waveform has been changed to equal three fundamental periods long. The charge electrode period equals the drop cluster formation period both in this embodiment and in the embodiment shown in FIG. 7. To create the three drop clusters, the waveform for each drop cluster period includes a first drop pulse 91, a second drop pulse 92, and a third drop pulse 90 for each period of the charging voltage waveform 97. In the absence of velocity modulation pulses 94, as in drop cluster cycles 1, 3, and 4, the three drops 35, 36, and 49 which are formed have the same velocity as each other so that they do not merge with each other. As shown in FIG. 8B, drop 36 breaks off during the first voltage state 95, and is therefore charged to a first charge state. Drops 35 and 49 break off during the second voltage state 96 and are charged to the second charge state. Due to these charge states, drop 36 is deflected to a first catcher, while drops 35 and 49 are deflected to a second catcher. Returning to FIG. 8A, the drop formation waveform 55 in the second and fifth drop cluster cycles includes a velocity modulation pulse 94 between the first drop pulse 91 and the second drop pulse 92. This velocity modulation pulse causes the first drop 35 and the second drop 36 to merge to form a merged drop 38. This merged drop 38 doesn't merge with the drop 49. Drop 36 breaks off during the first voltage state 95 of the charge electrode waveform so it is charged to a first voltage state. Drops 35 and 49 break off during the second voltage state and are each charged to a second charge state. When drops 36 and 35 merge to form merged drop 38, the merged drop has the sum of the charges on the drops 36 and 35. As the first voltage state is of approximately the small magnitude but of opposite polarity to the second voltage state, the charge on drop 36 is of approximately the same magnitude but of opposite sign to the charge on drop 35. As a result the merged drop 38 has near zero net charge. As a result, drop 38 is undeflected as it passes through the deflection field produced by the deflection electrodes 53. Drop 38 is therefore not caught by either catcher 47, and it strikes the print media 19. Drop 49, which was charged to the second charge state, is deflected by the deflection field so that it strikes the second catcher 47-2.

This embodiment, having three drops in the drop clusters, provides more consistent placement of the print drops within each pixel region on the print media than the two drops per drop cluster at certain print speeds. On the other hand, drop clusters with two drops per drop cluster provides more consistent placement of the print drops within each pixel region on the print media than the three drops per drop cluster at other print speeds. Furthermore drop clusters with two drops per drop cluster enable higher speed printing than drop clusters having three drops per drop cluster. The use of two drop clusters is preferred when the rate at which pixels are moved past the printhead is one half the rate of drop formation or when two drops are formed per nozzle during the time interval for a pixel to pass the printhead. The use of three drop clusters is preferred when the rate at which pixels are moved past the printhead is one third the rate of drop formation or when three drops are formed per nozzle during the time interval for a pixel to pass the printhead. As print speeds intermediate between these print speeds, a mix of two drop clusters and three drops clusters can be used; the mix ratio depending on the print speed, the drop formation rate, and the resolution, number of pixels per inch, in the print media travel direction. In certain embodiments, the printing system determines mix ratio of different charge electrode waveforms based on a measurement of the print speed. In other embodiments, the print system includes a clock that creates clock pulse at the fundamental period. The printing system determines on a pixel by pixel basis the number of clock pulses in each pixel time interval and a charge electrode waveform and the drop cluster size having a corresponding period is selected for that pixel interval. The selection of charge electrode waveforms and the corresponding drop cluster size depends on the print speed and/or the number of fundamental drops formed in the pixel time interval, but not on the print data for the pixel. That is, the charge electrode waveform used during a particular pixel interval doesn't depend on whether a drop is to be printed on that pixel or not.

The printing system can include a drop charge sensor to determine the charge of the merged drops. Based on the measured charge, the control can make voltage adjustments to one or both of the first and the second voltage states to drive the charge of the merged drop closer to zero. This can be beneficial as lower charge amplitudes on the print drops reduce the electrostatic drop-drop interactions that can affect drop placement on the print media.

The embodiment shown in FIG. 6 can be used to selectively print drops having the timing diagrams shown in FIG. 7-FIG. 8. The induced charge states on print drops and non-print drops depends upon the relative voltage levels of the voltage states 95 and 96 of the charge electrode waveform's 97. While FIGS. 7 and 8 have shown the first voltage state to be positive and the second voltage state, the polarity of the voltage states can be reversed.

Figure 9:
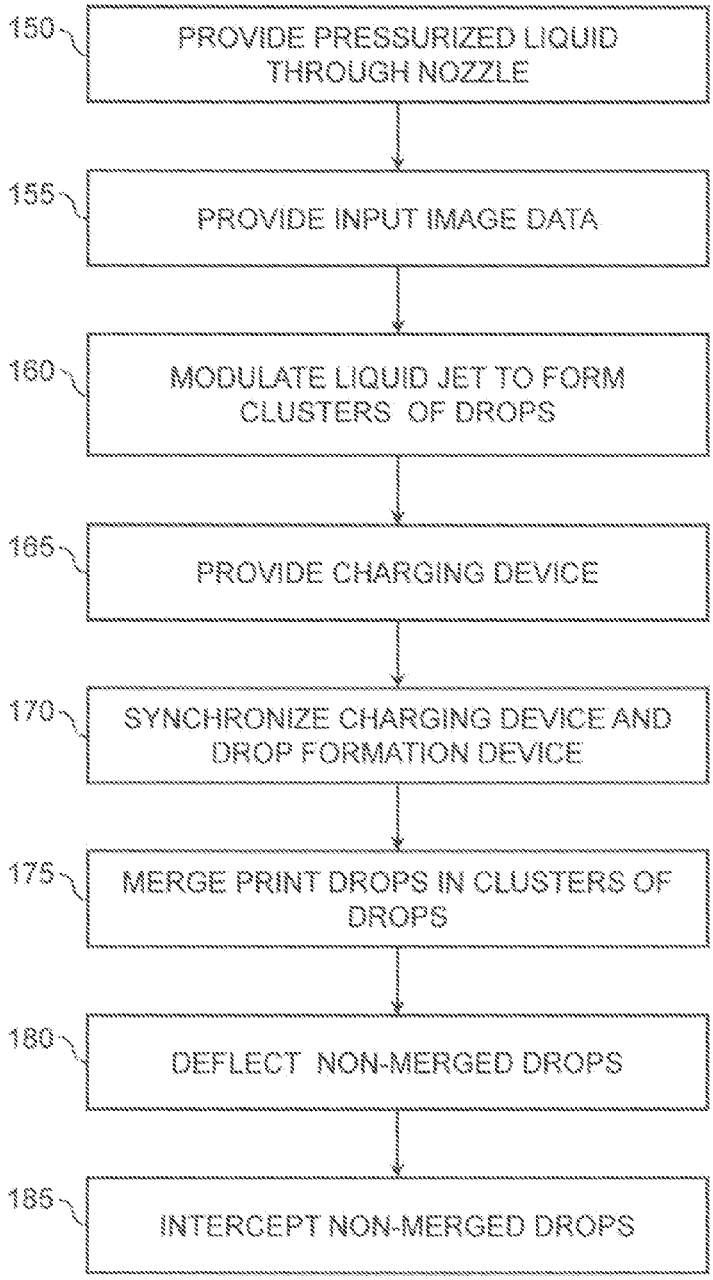
FIG. 9 shows a block diagram of a method of drop ejection according to an example embodiment of the invention.

FIG. 9 shows a block diagram outlining the steps required to practice the method of printing according to various embodiments of the invention. In step 150, pressurized liquid is provided under a pressure that is sufficient to eject a liquid jet through a nozzle or a linear array of nozzles. In step 155, input image data is provided. Input image data is usually in the form of binary data. In step 160, the liquid jets are selectively modulated to cause portions of the liquid jets to break off into one or more clusters of drops traveling along a path. Each cluster of drops includes a first drop and a second drop, and each cluster of drops is separated on average by a drop cluster period This is done by providing the drop formation devices associated with each of the liquid jets with drop formation waveforms and velocity modulation waveforms that cause portions of the liquid jets to break off into a series of merged print drops or non-print drops in response to image data. The input image data and the known recording medium speed during printing are used to determine which drop formation waveform and velocity modulation waveform is applied to each of the drop formation devices in an array of nozzles as a function of time. In an alternate embodiment, the clusters of drops include a third drop.

In step 165, a charging device is provided. The charging device includes a charge electrode and a source of time varying electrical potential. The charge electrode is common to and associated with each of the liquid jets. The source of time varying electrical potential applies a charge electrode waveform between the charge electrode and the liquid jets. The charge electrode waveform includes a first distinct voltage state and a second distinct voltage state and has a period that is equal to the drop cluster period. This results in a time varying electrical potential in the vicinity of drop break off from the liquid jets. The charge electrode waveform is independent of the image data applied to the drop formation devices of the nozzles.

In step 170, the charging device and the drop formation device are synchronized so that the first voltage state is active when first drops break off from the jets and the second voltage state is active when second drops break off from the liquid. This produces a first charge state on the first drop of the clusters of drops, and a second charge state on the second drop of the clusters of drops When the third drops are present in the clusters of drops the charging device and the drop formation device are synchronized to produce one of the first charge state and the second charge state on the third drops.

In step 175 the first and second drops of drop clusters are merged to form print drops. Drop merging mechanisms used in this invention include varying the velocity of the first and second drops of a drop cluster with a separate drop velocity modulation transducer, using drop velocity modulation pulses applied to the drop formation transducer, by electrostatic attraction of oppositely charged drops of the drop pair or by combinations of any two or more approaches. Drop merging can be accomplished by applying velocity modulation pulses to the drop formation transducers or to separate velocity modulation transducers associated with each of the nozzles in a nozzle array and/or by electrostatic attraction. Application of the drop merging mechanism causes the first drop and the second drop of the drop clusters to combine with each other to form a merged drop which has a third charge state.

In step 180, charged first drops, second drops and third drops are deflected. A deflection mechanism includes an electrostatic deflection device which causes the first drop to begin traveling along a first trajectory and causes the second drop to begin traveling along a second trajectory, the first and second trajectories being different when compared to each other. The third drops travel along one of the first or second trajectories. The merged print drops are not deflected and continue to travel along their original trajectories.

In step 185, drops traveling along the first trajectory and the second trajectory are intercepted by catchers for recycling. These drops are non print drops. The print drops that are not deflected are not intercepted by the catcher, and are allowed to contact the recording medium and are printed.

Generally this invention can be practiced to create print drops in the range of 1-100 pl, with nozzle diameters in the range of 5-50 μm, depending on the resolution requirements for the printed image. The jet velocity is preferably in the range of 10-30 m/s. The fundamental drop generation frequency is preferably in the range of 50-1000 kHz. The specific selection of these drop size, drop speed, nozzle size and drop generation frequency parameters is dependent on the printing application.

The invention allows drops to be selected for printing or non-printing without the need for a separate charge electrode to be used for each liquid jet in an array of liquid jets as found in conventional electrostatic deflection based ink jet printers. Instead a single common charge electrode is utilized to charge drops from the liquid jets in an array. This eliminates the need to critically align each of the charge electrodes with the nozzles. Crosstalk charging of drops from one liquid jet by means of a charging electrode associated with a different liquid jet is not an issue. Since crosstalk charging is not an issue, it is not necessary to minimize the distance between the charge electrodes and the liquid jets as is required for traditional drop charging systems. The common charge electrode also offers improved charging and deflection efficiency thereby allowing a larger separation distance between the jets and the electrode. Distances between the charge electrode and the jet axis in the range of 25-300 μm are useable. The elimination of the individual charge electrode for each liquid jet also allows for higher densities of nozzles than traditional electrostatic deflection continuous inkjet system, which require separate charge electrodes for each nozzle. The nozzle array density can be in the range of 75 nozzles per inch (npi) to 1200 npi.

The invention has been described in detail with particular reference to certain example embodiments thereof, but it will be understood that variations and modifications can be effected within the scope of the invention.

Parts List

10 Continuous Inkjet Printing System
11 Ink Reservoir
12 Printhead or Liquid Ejector
13 Image Source
14 Deflection Mechanism
15 Ink Recycling Unit
16 Image Processor
17 Logic Controller
18 Stimulation controller
19 Recording Medium
20 Ink Pressure Regulator
21 Media Transport Controller
22 Transport Rollers
25 Positively Charged Drop Trajectory
26 Negatively Charged Drop Trajectory
27 Charged Drop Catcher Contact Location
28 Merged Drop trajectory
32 Break off Location
34 Drop Pair
35 Second Drop
36 First Drop
38 Merged Drop
40 Continuous Liquid Ejection System
41 Drop Velocity Modulation Device Transducer
43 Liquid Jet
44 Charge electrode
44' Optional Symmetric Charge Electrode
46 Printed Drop
47-1 Catcher
47-2 Catcher
48 Ink Film
49 Third Drop
50 Nozzle
51 Charging Waveform Source
52 Catcher Face
53 Deflection Electrode
54 Velocity Modulation Source
55 Drop Stimulation Waveform
56 Drop Formation Waveform Source
57 Catcher Bottom Plate

58 Ink Recovery Channel
59 Drop Stimulation Transducer
83 Charging Device
87 Liquid Jet Central Axis
90 Third Drop Forming Pulse
91 First Drop Forming Pulse
92 Second Drop Forming Pulse
93 Phase Delay
94 Drop Velocity Modulating Pulse
95 First Voltage State
96 Second Voltage State
97 Charge Electrode Waveform
150 Provide Pressurized Liquid Step
155 Provide Input Image Data Step
160 Modulate Liquid Jet Step
165 Provide Charging Device Step
170 Synchronization Step
175 Merge Drop Pairs Step
180 Deflect Non-Merged Drops Step
185 Intercept Non-Merged Drops Step

The invention claimed is:

1. A method of ejecting liquid drops comprising:
providing liquid under pressure sufficient to eject a liquid jet through a nozzle of a liquid chamber;
providing input image data;
providing a drop formation device associated with the liquid jet;
providing a velocity modulation device;
providing a charging device including:
a charge electrode associated with the liquid jet; and
a source of varying electrical potential between the charge electrode and the liquid jet;
providing a first catcher and a second catcher, the first catcher being located on a first side of the liquid jet and the second catcher being located on a second side of the liquid jet;
providing a deflection device;
modulating the liquid jet using the drop formation device to cause portions of the liquid jet to break off into one or more clusters of drops traveling along a path, each cluster of drops separated on average by a drop cluster period, each cluster of drops including a first drop and a second drop;
providing a charging waveform to the charge electrode of the charging device using the source of varying electrical potential of the charging device, the charging waveform including a first voltage state and a second voltage state having opposing polarities when compared to each other, the charging waveform having a period that is equal to the drop cluster period, the charging waveform being independent of the input image data;
synchronizing the charging device with the drop formation device to produce a first charge state on the first drop of each drop cluster and produce a second charge state on the second drop of each drop cluster;
causing the first drop having a first charge state to be deflected away from the path and toward the first catcher and the second drop having a second charge state being deflected away from the path and toward the second catcher using the deflection device; and
modulating a relative velocity of the first drop and the second drop of a selected drop cluster using the velocity modulation device in response to input print data to cause the first drop and the second drop to form a merged drop traveling along the path, the merged drop having a third charge state that prevents the merged drop from being deflected to the first catcher by the deflection device and prevents the merged drop from being deflected to the second catcher by the deflection device.

2. The method of claim 1, wherein the drop formation device and the drop velocity modulation device are the same device.

3. The method of claim 1, wherein the first charge state and the second charge state have the same magnitude such that the third charge state is approximately zero net charge.

4. The method of claim 1, wherein the first drop and the second drop of the selected drop cluster combine prior to being acted upon by the deflection device.

5. The method of claim 1, wherein the deflection device includes at least one of the first catcher and the second catcher.

6. The method of claim 1, wherein the deflection device comprises a deflection electrode in electrical communication with a source of electrical potential that creates a drop deflection field to deflect charged drops.

7. The method of claim 1, the nozzle being one of a plurality of nozzles, wherein the charge electrode of the charging device is an electrode that is common to and associated with the liquid jets being ejected from the plurality of nozzles.

8. The method of claim 1, wherein the drop formation device further comprises:
a drop formation transducer associated with one of the liquid chamber, the nozzle, and the liquid jet; and
a drop formation waveform source that supplies a plurality of drop formation waveforms to the drop formation transducer, each waveform being selected in response to the input image data.

9. The method of claim 8, wherein the drop formation transducer is one of a thermal device, a piezoelectric device, a MEMS actuator, and an electrohydrodynamic device, an optical device, an electrostrictive device, and combinations thereof.

10. The method of claim 8, wherein the plurality of drop formation waveforms includes a first drop formation waveform that creates the first and second drops of the drop clusters.

11. The method of claim 1, wherein the drop velocity modulation device further comprises:
a drop velocity modulation transducer associated with one of the liquid chamber, the nozzle, and the liquid jet; and
a drop velocity modulation waveform source that supplies a drop velocity modulation waveform to the drop velocity modulation transducer in response to the input image data.

12. The method of claim 11, wherein the drop velocity modulation transducer is one of a thermal device, a piezoelectric device, a MEMS actuator, and an electrohydrodynamic device, an optical device, an electrostrictive device, and combinations thereof.

13. The method of claim 11, wherein the drop velocity modulation waveform is supplied to the drop velocity modulation transducer during the time that the liquid jet is modulated to selectively cause portions of the liquid jet to break off into one or more pairs of drops.

14. The method of claim 1, wherein the source of varying electrical potential between the charge electrode and the liquid jet produces a waveform in which the first distinct voltage state and the second distinct voltage state are each active for a time interval equal to one half of the drop cluster period.

15. The method of claim 1, wherein the charging device comprises a charge electrode including a first portion positioned on a first side of the liquid jet and a second portion positioned on a second side of the liquid jet.

16. The method of claim 1, wherein the liquid includes ink for printing on a recording medium.

17. The method of claim 1, wherein modulating the liquid jet using the drop formation device to selectively cause portions of the liquid jet to break off into one or more clusters of drops traveling along a path includes modulating the liquid jet using the drop formation device to selectively cause portions of the liquid jet to break off into a third drop.

18. The method of claim 17, wherein synchronizing the charging device with the drop formation device to produce a first charge state on the first drop of each drop cluster and produce a second charge state on the second drop of each drop cluster includes synchronizing the charging device with the drop formation device to produce one of the first charge state and the second charge state on the third drop.

19. A continuous liquid ejection system comprising:

a liquid chamber in fluidic communication with a nozzle, the liquid chamber containing liquid under pressure sufficient to eject a liquid jet through the nozzle;

a processor configured to provide input image data;

a drop formation device associated with the liquid jet that modulates the liquid jet to cause portions of the liquid jet to break off into one or more clusters of drops traveling along a path, each cluster of drops separated on average by a drop cluster period, each cluster of drops including a first drop and a second drop;

a charging device including:

a charge electrode associated with the liquid jet; and a source of varying electrical potential between the charge electrode and the liquid jet that provides a charging waveform to the charge electrode, the charging waveform including a first voltage state and a second voltage state having opposing polarities when compared to each other, the charging waveform having a period that is equal to the drop cluster period, the charging waveform being independent of the input image data, the charging device and the drop formation device being synchronized to produce a first charge state on the first drop of each drop cluster and produce a second charge state on the second drop of each drop cluster;

a first catcher located on a first side of the liquid jet;

a second catcher located on a second side of the liquid jet;

a deflection device that causes the first drop having a first charge state to be deflected away from the path and toward the first catcher and the second drop having a second charge state being deflected away from the path and toward the second catcher; and a velocity modulation device that modulates a relative velocity of the first drop and the second drop of a selected drop cluster in response to input print data to cause the first drop and the second drop to form a merged drop traveling along the path, the merged drop having a third charge state that prevents the merged drop from being deflected to the first catcher by the deflection device and prevents the merged drop from being deflected to the second catcher by the deflection device.

* * * * *